US007202409B2

(12) United States Patent
Fujiwara et al.

(10) Patent No.: US 7,202,409 B2
(45) Date of Patent: Apr. 10, 2007

(54) MUSICAL INSTRUMENT AUTOMATICALLY PERFORMING MUSIC PASSAGE THROUGH HYBRID FEEDBACK CONTROL LOOP CONTAINING PLURAL SORTS OF SENSORS

(75) Inventors: Yuji Fujiwara, Shizuoka (JP); Yasuhiko Ohba, Shizuoka (JP)

(73) Assignee: Yamaha Corporation, Shizuoka-Ken (JP)

( * ) Notice: Subject to any disclaimer, the term of this patent is extended or adjusted under 35 U.S.C. 154(b) by 203 days.

(21) Appl. No.: 11/030,548

(22) Filed: Jan. 6, 2005

(65) Prior Publication Data

US 2006/0016325 A1 Jan. 26, 2006

(30) Foreign Application Priority Data

Jan. 6, 2004 (JP) ..... 2004-000869

(51) Int. Cl.
*G10H 1/32* (2006.01)
*G10H 3/00* (2006.01)

(52) U.S. Cl. ..... 84/743; 84/718; 84/723; 84/17; 84/19

(58) Field of Classification Search ..... None
See application file for complete search history.

(56) References Cited

U.S. PATENT DOCUMENTS 5,627,333 A * 5/1997 Stahnke et al. ..... 84/462
5,648,621 A * 7/1997 Sasaki ..... 84/171
5,652,399 A 7/1997 Fujiwara et al.
6,051,762 A * 4/2000 Fujiwara et al. ..... 84/21
6,245,985 B1 6/2001 Sasaki et al.
6,271,447 B1 8/2001 Fujiwara et al.
6,359,207 B1 * 3/2002 Oba et al. ..... 84/658
2006/0016325 A1 * 1/2006 Fujiwara et al. ..... 84/723
2006/0053999 A1 * 3/2006 Sasaki ..... 84/13

FOREIGN PATENT DOCUMENTS

JP 06-236177 8/1994
JP 7-175471 7/1995
JP 2000-276134 10/2000

* cited by examiner

*Primary Examiner*—Marlon Fletcher
(74) *Attorney, Agent, or Firm*—Harness, Dickey & Pierce, PLC

(57) ABSTRACT

An automatic player piano includes keys driven for the angular motion through a hybrid feedback control loop; a controller, a key position sensor, a plunger velocity sensor and a solenoid-operated key actuator form parts of the hybrid feedback control loop for each key, and a current key position and a plunger velocity are reported to the controller; the controller determines a series of target position or a reference trajectory and a target velocity, and periodically compares a composite current position and a composite current velocity, which are determined on the basis of the current key position and current plunger velocity, with the target position and target velocity to see whether or not the key travels on the reference trajectory; if the answer is negative, the controller adjusts the driving signal to a proper duty ratio so as to force the key to travel on the reference trajectory.

20 Claims, 5 Drawing Sheets

MUSICAL INSTRUMENT AUTOMATICALLY PERFORMING MUSIC PASSAGE THROUGH HYBRID FEEDBACK CONTROL LOOP CONTAINING PLURAL SORTS OF SENSORS

FIELD OF THE INVENTION

This invention relates to a musical instrument and, more particularly, to a musical instrument automatically performing a piece of music through feed-back control loops.

DESCRIPTION OF THE RELATED ART

An automatic player piano is a typical example of the musical instrument automatically performing a piece of music. The automatic player piano is broken down into an acoustic piano and an automatic playing system. A recording system may be further incorporated in the automatic player piano.

The prior art automatic playing system includes solenoid-operated key actuators, feedback sensors and a controller. The solenoid-operated key actuators are respectively provided under the rear portions of the black/white keys, which are made of wood, and the rear portions of the black/white keys are selectively pushed upwardly with the plungers of the associated solenoid-operated key actuators in the playback. The controller is connected between the feedback sensors and the solenoid-operated key actuators, and renders the black/white keys respectively travelling along reference trajectories at appropriate timing.

While the black/white keys are being driven by means of the associated solenoid-operated key actuators, the feedback sensors directly or indirectly monitor the black/white keys so as to report current key positions to the controller. The controller compares the current key positions with the target key positions on the reference trajectories to see whether or not the black/white keys exactly travel along the reference trajectories. When the answer is given affirmative, the controller continuously keeps the duty ratio of the driving signals. However, if the controller finds a black/white key to be ahead of or late for the target position, the controller decreases or increases the duty ratio of the driving signal in order to make the black/white key captures the target position. Thus, the controller, each solenoid-operated key actuator and associated feedback sensor form in a feedback control loop for the associated black/white key.

The prior art automatic player piano is, by way of example, disclosed in Japanese Patent Application laid-open No. Hei 7-175471, which is corresponding to Japanese Patent Application No. Hei 5-344242, and the Japanese Patent Application offered the convention priority right to the U.S. patent application already assigned U.S. Pat. No. 5,652,399. Another prior art automatic player piano is disclosed in Japanese Patent Application laid-open No. 2000-276134, which is corresponding to Japanese Patent Application No. Hei 11-284135, and the Japanese Patent Application offered the convention priority right to the U.S. patent application already assigned U.S. Pat. No. 6,271,447B1.

The feedback sensors are respectively provided inside of the solenoid-operated key actuators incorporated in both prior art automatic player pianos disclosed in the Japanese Patent Application laid-open. Namely, only one sort of feedback sensors forms parts of the feedback control loops. The prior art automatic player pianos were designed on the assumption that the plunger motion is same as the key motion. However, the solenoid-operated key actuator and black/white key are independent of each other.

The plungers are rigid, and the solenoids are electromagnetically coupled with the associated plungers so as to exert thrust on the plunger in the magnetic field. On the other hand, the woody black/white key is deformable, and is loosely coupled with the balance pin on the balance rail. While the plunger is projecting from the solenoid, the plunger continuously exerts the force on the rear portion of the woody black/white key. However, the force is partially consumed in the deformation of the black/white key. Moreover, the plunger motion is partially converted to the slip of the black/white key on the balance rail. This means that the black/white keys do not faithfully follow the plungers. When the plunger gives rise to slow key motion between the rest position to the end position, the difference between the plunger motion and the key motion may be ignoreable. However, quick repetition such as trill makes the difference serious.

To make the matter worse, the difference between the plunger motion and the key motion is irregular. If the difference were regular, the controller would make the key motion consistent with the plunger motion by modifying the driving signal. However, the irregularity makes it impossible to do so. As a result, the array of solenoid-operated key actuators merely gives rise to pseudo key motion in the playback. This is the reason why the listeners feel the performance in the playback inaccurate.

SUMMARY OF THE INVENTION

It is therefore an important object of the present invention to provide a musical instrument, which exactly reenacts a performance.

To accomplish the object, the present invention proposes to properly weight a physical quantity of component members such as the keys and another physical quantity of movable members such as the plungers.

In accordance with one aspect of the present invention, there is provided an automatic player musical instrument for producing music sound comprising a sound generator actuated for producing the music sound at different pitches, plural link works making a motion so as to actuate the sound generator and having respective component parts and a control loop associated with the component parts, and the control loop includes a data generator outputting pieces of control data representative of reference trajectories on which the component parts are expected to travel, plural actuators provided in association with the component parts, respectively, having respective movable members for exerting force on the component parts and responsive to driving signals so as to give rise to the motion through the movable members, sensors respectively monitoring the component parts and producing detecting signals representative of a physical quantity of the component parts, other sensors respectively monitoring the movable members and producing other detecting signals representative of another physical quantity of the movable members, a servo controller connected to the data generator, the sensors and the other sensors, determining pieces of target data representative of a target physical quantity and another target physical quantity, respectively weighting the physical quantity and the aforesaid another physical quantity by a weighting factor and another weighting factor for producing pieces of status data representative of a weighted physical quantity and another weighted physical quantity and comparing the target physical quantity and the aforesaid another target physical quantity with the weighted physical quantity and the aforesaid another weighted physical quantity for determining a piece of instruction data representative of a proper magnitude of the driving signals and a modulator connected between the servo controller and the plural actuators and responsive to the piece of instruction data for adjusting the driving signals to the proper magnitude.

BRIEF DESCRIPTION OF THE DRAWINGS

The features and advantages of the musical instrument will be more clearly understood from the following description taken in conjunction with the accompanying drawings, in which.

DESCRIPTION OF THE PREFERRED EMBODIMENTS

Figure 1:
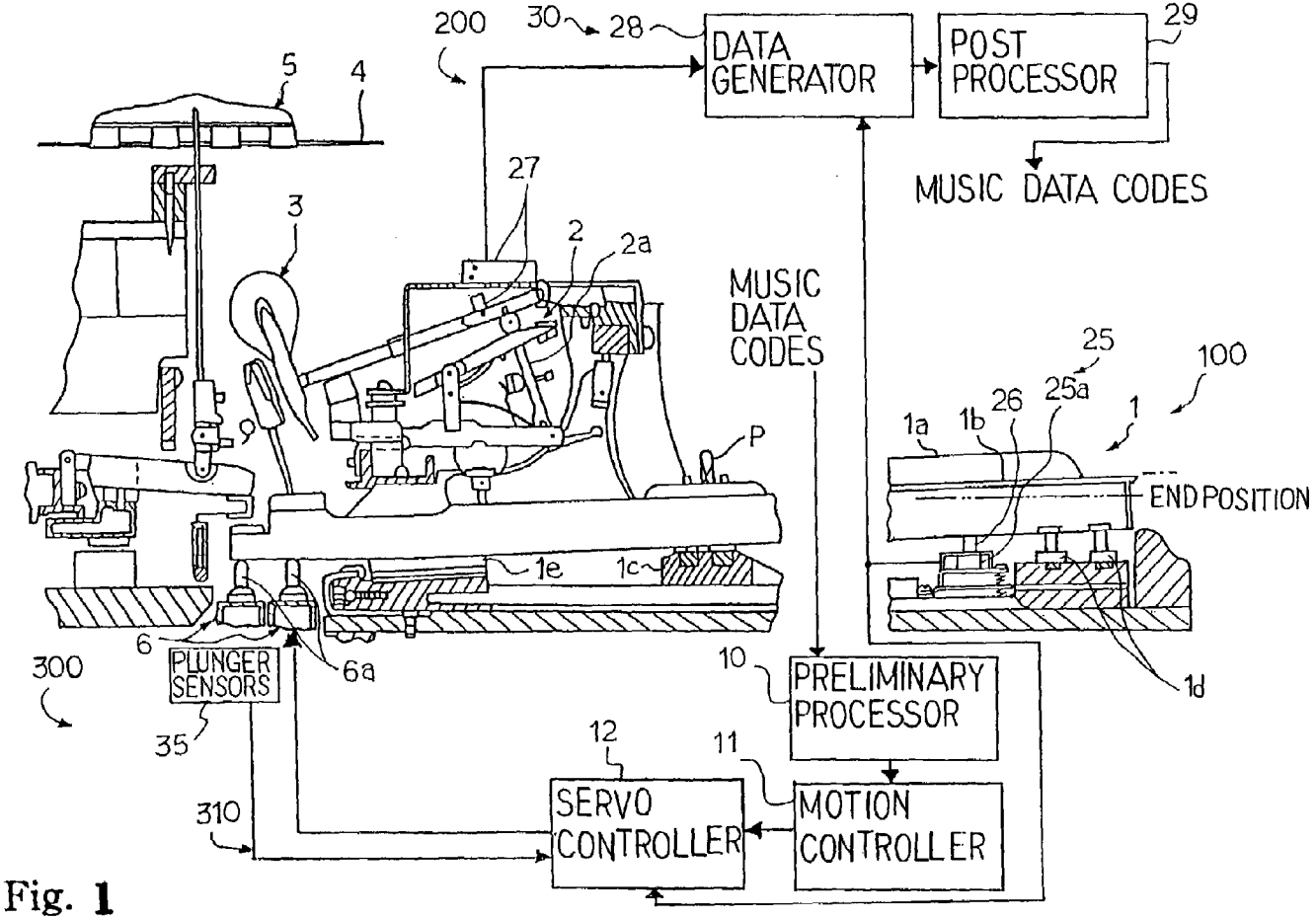
FIG. 1 is a side view showing the structure of an automatic player piano according to the present invention.

In the following description, term "front" is indicative of a position closer to a player, who is sitting on a stool for fingering, than a position modified with term "rear". A line, which is drawn between a front position and a corresponding rear position, extends in a fore-and-aft direction, and a lateral direction crosses the fore-and-aft direction at right angle.

An automatic player musical instrument according to the present invention largely comprises an acoustic musical instrument and a control loop. The acoustic musical instrument includes a sound generator and plural link works. The sound generator is operative to generate music sound at different pitches, and a human player or the control loop gives rise to motion in the plural link works so as to activate the sound generator.

The control loop includes a data generator, plural actuators, sensors, other sensors, servo controller and a modulator. The plural actuators have respective movable members, and the movable members exert force on component parts of the link works. The sensors respectively monitor the component parts for producing detecting signals representative of a physical quantity of the component parts, and the other sensors respectively monitor the movable members for producing other detecting signals representative of another physical quantity of the movable members. The detecting signals and other detecting signals are supplied to the servo controller, and the servo controller processes the magnitude of physical quantity and the magnitude of another physical quantity for regulating driving signals, which are supplied to the actuators, to a proper magnitude.

When a user instructs the automatic player musical instrument to reproduce a music passage, music data codes are supplied to the data generator so as to determine reference trajectories for the component parts, and the servo controller starts to supply the driving signals to selected ones of the component parts. The actuators are responsive to the driving signals so as to sequentially exert the force on selected ones of the component parts. The force gives rise to the motion of the link works, and the link works activate the sound generator for producing the music sound at different pitches.

While the control loop is selectively moving the component parts, the data generator gives the pieces of control data representative of the reference trajectories to the servo controller, and the sensors and other sensors report the current physical quantity of the component parts and another physical quantity of the movable members to the servo controller. When a reference trajectory reaches the servo controller, the servo controller determines the target physical quantity and another target physical quantity for the component part and movable member, respectively, and weights the current physical quantity and another current physical quantity by multiplying them by a weighting factor and another weighting factor. The weighted physical quantity and another weighted physical quantity are compared with the target physical quantity and another target physical quantity to see whether or not the component part travels on the reference trajectory.

When the answer is given affirmative, the servo controller requests the modulator to keep the driving signal. If, on the other hand, the component part is ahead or delayed, the answer is given negative, and the servo controller supplies a piece of instruction data representative of a proper magnitude of the driving signal to the modulator. Thus, the control loop forces the component parts to travel on the reference trajectories. This results in that the music sound same as that in the original performance.

The weighting job is carried out from at least three aspects. First, the servo controller determines another physical quantity of the component part on the basis of the physical quantity reported from the sensor, and the physical quantity of the movable member on the basis of another physical quantity reported from the other sensor. The physical quantity of the component part and physical quantity of the movable member are appropriately weighed so as to produce the weighted physical quantity, and another physical quantity of the component part and another physical quantity of the movable member are also appropriately weighted so as to produce another weighted physical quantity. In other words, the weighting job is carried out on the same sort of the physical quantity. Thus, the servo controller makes the motion of the component parts correspond to the motion of the component parts through the comparison repeated more than once in the same sort of the physical quantity.

Second, when another physical quantity is a different sort from the physical quantity, the physical quantity of the component part is appropriately weighted so as to produce the weighted physical quantity, and another physical quantity of the movable member is appropriately weighted so as to produce another weighted physical quantity. In other words, the weighting job is carried on the different sorts of physical quantity. Thus, the servo controller makes the motion of the component parts correspond to the motion of the component parts through the simple comparison between the different sorts of the physical quantity.

Third, if both the sensors report a certain sort of physical quantity, i.e., the physical quantity and another physical quantity belong to the certain sort of physical quantity, the servo controller makes the motion of the component parts correspond to the motion of the component parts through the simple comparison in the same sort of the physical quantity.

First Embodiment

Referring to FIG. 1 of the drawings, an automatic player piano embodying the present invention largely comprises an acoustic piano 100, a recording system 200 and an automatic playing system 300. The recording system 200 and automatic playing system 300 are installed inside of the acoustic piano 100, and cooperate with the acoustic piano 100.

When a user wishes to record his or her performance, he or she instructs the recording system 200 to produce music data codes representative of the performance, and starts to play a piece of music on the acoustic piano 100. While the user is fingering on the acoustic piano 100, the recording system 200 monitors the key motion and hammer motion, and produces music data codes representative of the tones produced and, thereafter, decayed. The music data codes are supplied to a destination in a real time manner, or are stored in a suitable memory upon completion of the performance. Thus, the recording system 200 cooperates with the acoustic piano so as to record user's performance.

When the user wishes to reenact the performance without any fingering on the acoustic piano, he or she instructs the automatic playing system 300 to reproduce the tones on the basis of the music data codes. The automatic playing system 300 sequentially processes the music data codes, and determines tones to be reproduced at proper loudness and the timing to reproduce the tones. The automatic playing system 300 drives the acoustic piano 100 to produce the tones at the timing so that the original performance is reenacted by the automatic playing system 300. Thus, the automatic playing system 300 cooperates with the acoustic piano so as to reenact the performance.

The acoustic piano 100 is of the grand type, and includes a keyboard 1, action units 2, hammers 3, strings 4 and dampers 5. Black keys 1*a* and white keys 1*b* are laid on the well-known pattern, and are laterally arranged on a balance rail 1*c*. The black/white keys 1*a*/1*b* are made of wood, and are deformable.

Balance pins P project over the balance rail 1*c*, and offer the fulcrums of the key motion to the associated black/white keys 1*a*/1*b*. Holes are vertically formed in the middle portions of the black/white keys 1*a*/1*b*, and the balance key pins P loosely pass through the holes. For this reason, while the black/white key 1*a*/1*b* is rotating from a rest position to an end position, the contact area between the black/white key 1*a*/1*b* and the balance rail 1*c* is varied in the fore-and-aft direction, and the front portions of the black/white keys 1*a*/1*b* are brought into contact with front pin cloth punchings 1*d* at the end position. When the black/white key 1*a*/1*b* is released at the end position, the black/white key 1*a*/1*b* rotates in the opposite direction, and the rear portion is brought into contact with a back rail felt 1*e*. Since the front pin cloth punchings 1*d* and back rail felt 1*e* are not rigid, the black/white key 1*a*/1*b* is slightly moved at the end position and rest position. Thus, the key motion is complicated, and is not uniform.

The keyboard 1 is linked with the action units 2 and dampers 4, and the hammers 3 are further linked with the associated action units 2 under the strings 4. A human player or the automatic playing system 300 gives rise to the key motion, and makes the black/white keys 1*a*/1*b* selectively activate the dampers 4 and associated action units 2. The dampers 4 are provided over the rearmost portions of the black/white keys 1*a*/1*b*, and are spaced from and brought into contact with the associated strings 4. The action units 2 are provided over the rear halves of the black/white keys 1*a*/1*b*, and drive the associated hammers 3 for rotation toward the strings 4.

A user is assumed to depress the front portion of a black/white key 1*a*/1*b*. The depressed key 1*a*/1*b* upwardly pushes the associated damper 5 on the way to the end position, and makes the damper 5 spaced from the string 4. The damper 5 permits the string 4 to vibrate. Thereafter, the depressed key 1*a*/1*b* causes a jack 2*a*, which forms a part of the action unit 2, to escape from the hammer 3. In other words, the depressed key 1*a*/1*b* causes the action unit 2 to give rise to the free rotation of the hammer 3. The hammer 3 is brought into collision with the string 4, and gives rise to the vibrations of the string 4. The hammer 3 rebounds on the string 4, and is received on the action unit 2. When the user releases the depressed key 1*a*/1*b*, the action unit 2 starts to return to the rest position, and the damper 5 is brought into contact with the string 4 on the way of the released key 1*a*/1*b* toward the rest position.

The recording system 200 includes a data generator 28, a post processor 29, key sensors 25, i.e., combinations of optical modulators 26 and photo-couplers 25*a*, and hammer sensors 27. The optical modulators 26 are respectively attached to the lower surfaces of the black/white keys 1*a*/1*b*, and the photo-couplers 25*a* radiate optical beams across the trajectories of the optical modulators 26. The optical beam has a cross section wide enough to monitor the keystroke from the rest position to the end position. Thus, the key sensors 25 are respectively associated with the black/white keys 1*a*/1*b*, and monitor the key motion. While a black/white key 1*a*/1*b* is traveling from the rest position to the end position, the optical modulator 26 gradually varies the amount of light incident on the photo-detecting element of the photo-coupler so as to change the magnitude of the key position signal.

The hammer sensors 27 are similar to the key sensors 25. The hammer sensors 27 are respectively associated with the hammers 150, and monitors the hammer motion. The key sensors 25 and hammer sensors 27 are connected to the data generator 28, and supply key position signals representative of current key positions of the associated black/white keys 1*a*/1*b* and hammer position signals representative of current hammer positions of the associated hammers 3 to the data generator 28.

Figure 2:
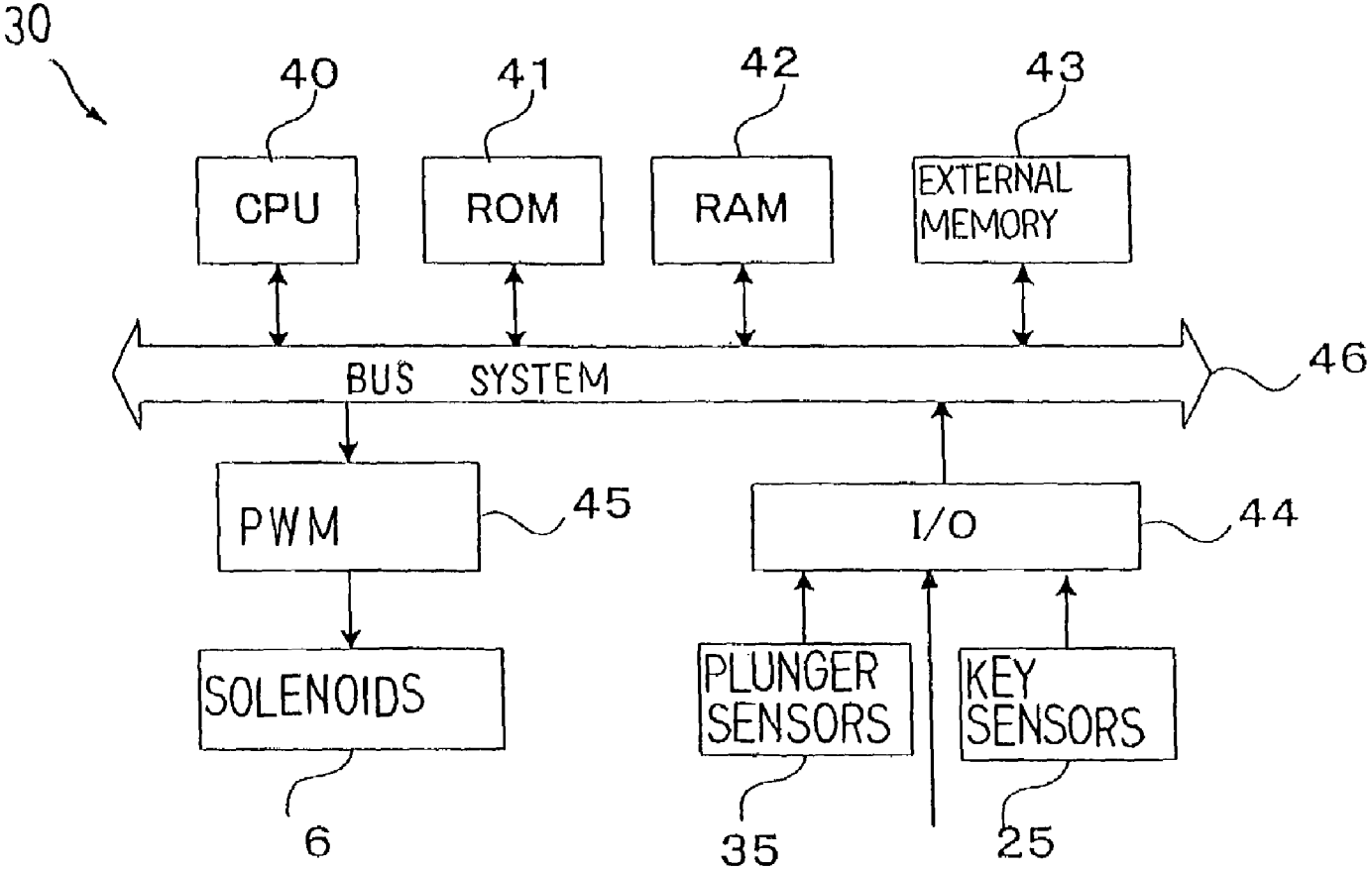
FIG. 2 is a block diagram showing the system configuration of a controller incorporated in the automatic player piano.

The data generator 28 and post processor 29 stand for particular functions of a controller 30, which will be hereinlater described in conjunction with FIG. 2. The data generator 28 periodically fetches the pieces of positional data representative of the current key positions and current hammer positions, and accumulates them in queues respectively assigned to the pitch names. The data generator 28 analyzes the pieces of positional data to see whether or not the user depresses or releases any one of the black/white keys 1*a*/1*b*. When the data generator 28 finds a depressed key 1*a*/1*b*, the data generator 28 specifies the pitch name of the depressed key 1*a*/1*b*, and determines the loudness, which is proportional to the hammer velocity immediately before the strike at the string 4. The data generator 28 produces a piece of music data representative of the pitch name and loudness, i.e., velocity. On the other hand, when the data generator 28 finds a released key, the data generator specifies the pitch name of the released key, and determines the released velocity. The data generator 28 produces a piece of music data representative of the pitch name and released velocity. Thus, the data generator 28 intermittently produces the pieces of music data representative of the tones produced and decayed in the performance.

The pieces of music data are transferred from the data generator 28 to the post processor 29. The post processor 29 eliminates individualities of the key sensors 25 from the pieces of music data. Namely, the post processor 29 normalizes the pieces of music data. The pieces of music data thus normalized are coded in predetermined formats, and the music data codes are supplied to a suitable memory. Otherwise, the music data codes are supplied to another musical instrument in a real time fashion. The formats may be defined in certain music data protocols such as, for example, the MIDI protocols.

The automatic playing system 300 includes solenoid-operated key actuators 6, a preliminary processor 10, a motion controller 11, a servo controller 12, plunger sensors 35, plunger sensors 35 and the key sensors 25. The preliminary processor 10, motion controller 11 and servo controller 12 represent different functions of the controller 30. Each solenoid-operated key actuator 6 includes a solenoid and a plunger 6*a*, and the tips of the plungers 6*a* are in close proximity with or slightly held in contact with the lower surfaces of the associated black/white keys 1*a*/1*b* at the rest positions. The servo controller 12 supplies driving signals to the solenoids of the solenoid-operated key actuators 6, and gives rise to plunger motion.

The plunger sensors 25 are of a moving-magnet type, and detect the plunger velocity of the associated plungers 6*a*. The key sensors 25 and plunger sensors 35 are connected to the servo controller 12, and plunger velocity signals and the key position signals are supplied from the plunger sensors 35 and key sensors 25 to the servo-controller 12. Thus, the key sensors 25 and controller 30 are shared between the recording system 200 and the automatic playing system 300.

The preliminary processor 10 determines reference trajectories on the basis of the music data codes. The reference trajectory is a target position of the black/white key 1*a*/1*b* varied with time. The music data codes are supplied from the memory to the preliminary processor 10. Sets of music data codes may be supplied from a provider through a communication network such as, for example, the internet.

The motion controller 11 is supplied with the data codes representative of the reference trajectories, and determines the target amount of mean current of the driving signals or the duty ratio of the driving signals at intervals on the basis of the data codes.

Data codes representative of the target amount or duty ratio are supplied to the servo controller 12. The servo controller 12 regulates the duty ratio of the driving signals to the target values, and supplies the driving signals to the solenoids of the key actuators 6. While the solenoid-operated key actuators 6 are driving the black/white keys 1*a*/1*b* for rotation, the plunger sensors 35 and key sensors 25 supplies the plunger velocity signals and key position signals to the servo controller 12, and the servo controller 12 modifies the duty ratio of the driving signals with the pieces of control data supplied through the plunger velocity signals and key position signals as will be hereinlater described in detail.

System Configuration of Recorder

Turning to FIG. 2 of the drawings, the controller 30 includes a central processing unit 40, which is abbreviated as "CPU", a read only memory 41, which is abbreviated as "ROM", a random access memory 42, which is abbreviated as "RAM", an external memory 43, an interface 44, which are abbreviated as "I/O" and a shared bus system 46. The external memory unit 43 is, by way of example, implemented by a hard disk unit, a flexible disk unit, a floppy disk (trademark) driver, a CD driver for CD-ROMs, CD-RAMs, optomagnetic disks, ZIP disks or DVDs (Digital Versatile Disks) or a memory board where semiconductor memories are mounted. The interface 44 includes analog-to-digital converters. The key position signals, hammer position signals and plunger velocity signals are supplied to the analog-to-digital converters so that digital key positional signals, digital hammer position signals and digital plunger velocity signals are output to the shared bus system 64. Though not shown in FIG. 2, a manipulating panel is further connected to the interface 44, and users give their instructions to the controller 30 through the manipulating panel. The central processing unit 40 periodically fetches the pieces of positional data representative of the current key positions, current hammer positions and current plunger velocities from the interface 44.

The central processing unit 40, random access memory 42, read only memory 41, the external memory 43, pulse width modulator 45 and interface 44 are connected to the shared bus system 46 so that the central processing unit 40 can communicate with the other components 40/41/42/43/44/45 through the shared bus system 46.

Computer programs, i.e., a main routine program and subroutine programs, and tables of parameters are stored in the read only memory 41, and the random access memory 42 serves as a working memory. The central processing unit 40 runs on the main routine program, and conditionally enters the subroutine programs so as to accomplish given tasks. The central processing unit 40 acknowledges user's instructions and increments software timers during the execution of the main routine program. The central processing unit 40 selectively starts and stops the software timers, and measures lapses of time from the previous event to the present event. The central processing unit 40 produces music data codes representative of MIDI messages in the execution of the subroutine program assigned to the recording system 200. The central processing unit 40 further produces control data codes representative of the suitable driving signals on the basis of the music data codes in the execution of the subroutine program assigned to the automatic playing system 300.

Sets of music data codes representative of the MIDI messages, i.e., MIDI music data codes are stored in the external memory 43. In other words, the performance is recorded in the external memory 43. The set of music data codes representative of the performance on the acoustic piano 100 is supplied from the random access memory 42 to the external memory 43 upon completion of the performance. Otherwise, the set of music data codes may be supplied to a suitable data storage through a communication network.

The pulse width modulator 45 adjusts the mean current of the driving signals i.e., the duty ratio to a value given from the central processing unit 40. The larger the duty ratio, the stronger the magnetic field, i.e., the thrust exerted on the plungers 6*a*. In other words, the central processing unit 40 controls the key motion by changing the duty ratio of the driving signals through the pulse width modulator 45.

The manipulating panel (not shown) is a man-machine interface. Various switches, levers, indicators and a display window are provided on the manipulating panel, and a user gives instructions to the central processing unit 40 by manipulating these switches and levers.

While a pianist is performing a piece of music on the acoustic piano 100, the central processing unit 40 runs on the computer program so as to produce the MIDI music data codes. In detail, the central processing unit 40 periodically fetches the current key positions and current hammer positions from the analog-to-digital converters in the interface 44, and adds pieces of positional data representative of the current key positions and pieces of positional data representative of current hammer positions to the queues assigned to the black/white keys 1*a*/1*b* and hammers 3. The queues are created in the random access memory 42. The pieces of positional data in the queues are reset at the time when the central processing unit 40 acknowledges events, i.e., note-on events and note-off events to occur. The central processing unit 40 checks the queues to see whether or not any key 130 is moved.

When the central processing unit 40 finds a black/white key 1*a*/1*b* to exceed a point for the note-on event or note-off event, the central processing unit 40 determines the key motion, i.e. the note number assigned to the black/white key 1*a*/1*b*, hammer velocity representative of the loudness, depressing velocity, releasing velocity etc., and produces the MIDI voice message for the tone to be produced or decayed. The central processing units 40 further starts the timer at the occurrence of the MIDI voice message, and stops the timer at the occurrence of the next MIDI voice message. The central processing unit 40 measures the lapse of time between the MIDI events, and produces a duration data code representative of the lapse of time. Thus, the central processing unit 40 intermittently produces the pieces of music data representative of the MIDI voice messages and pieces of duration data representative of the lapse of time. The data generator 28 is representative of this function.

Subsequently, the central processing unit 40 normalizes the pieces of music data codes. The acoustic piano 100 exhibits individuality due to the key/hammer sensors 25/27 offset from the target positions, instrumental errors, dimensional tolerance of the component parts of the acoustic piano 100 and so forth. The individuality makes the automatic player piano show a tendency. The central processing unit 40 finds the tendency, and eliminates the noise components due to the individuality from the pieces of music data. Thus, the pieces of music data are normalized to those of a standard automatic player piano. This function is represented by the post processor 29.

The pieces of music data, which have been already normalized, are coded in the formats defined in the MIDI protocols. The set of music data codes, which represents the performance on the acoustic piano 100, is transferred to the external memory 43, and are stored therein. The set of music data codes may be put in a standard MIDI file. Otherwise, the music data codes are transmitted through the communication network to another MIDI musical instrument in the real time fashion.

The user is assumed to instruct the automatic playing system 300 to reenact the performance. Then, the main routine program periodically branches into the subroutine program for the playback. The central processing unit 40 requests the external memory 43 to transfer the set of music data codes to the random access memory 42, and reads out the music data codes in sequence of time.

When the music data code representative of the note-on event is read out from the random access memory 42, the central processing unit 40 analyzes the piece of music data, and determines the reference trajectory for the black/white key 1*a*/1*b* to be moved. The target key position on the reference trajectory is varied together with time. The target key position is, by way of example, determined at intervals of 1 millisecond. This function is represented by the preliminary processor 10.

When the timing, which is specified by the associated duration code, comes, the central processing unit 40 calculates a target plunger velocity and a target plunger acceleration, and determines the duty ratio, which is expected to make the plunger 6*a* get the target plunger velocity and the black/white key 1*a*/1*b* reach the target key position, of the driving signal, and supplies the control data code representative of the duty ratio to the pulse width modulator 45. This function is represented by the motion controller 11.

The pulse width modulator 45 adjusts the driving signal to the duty ratio, and supplies the driving signal to the solenoid of the associated solenoid-operated key actuator 6. The plunger 6*a* starts to project, and gives rise to the key motion. The key sensor 25 and plunger sensor 35 report the current key position and current plunger velocity to the controller 30.

The central processing unit 40 periodically fetches the piece of positional data representative of the current key position and the piece of velocity data representative of the current plunger velocity from the interface 44, and calculates the current key velocity and current plunger position/current plunger acceleration on the basis of the current key position and current plunger velocity, respectively. The central processing unit 40 normalizes the pieces of positional data, and weights the current key position, current plunger position, the current key velocity and current plunger velocity, and determines a current weighted position and a current weighted velocity.

The central processing unit 40 compares the current weighted position, current weighted velocity and current plunger acceleration with the target key position, target plunger velocity and target plunger acceleration to see whether or not the black/white key 1*a*/1*b* properly travels on the reference trajectory. When the answer is given affirmative, the central processing unit 40 requests the pulse width modulator 45 to keep the duty ratio. However, if the answer is given negative, the central processing unit 40 respectively multiplies the difference between the current weighted position and the target position, a difference between the current weighted velocity and the target velocity and a difference between the current plunger acceleration and the target plunger acceleration by predetermined gains, and adds the constant bias to the differences so as to determine a proper duty ratio. The central processing unit 40 notifies the pulse width modulator 45 of the proper duty ratio.

The pulse width modulator 45 adjusts the driving signal to the proper duty ratio, and supplies the driving signal to the solenoid so that the solenoid increases or decreases the thrust exerted on the plunger 6*a*. This function is represented by the servo controller 12.

As will be understood, the controller 30, solenoid-operated key actuators 6, black/white keys 1*a*/1*b* and key sensors/plunger sensors 25/35 form a hybrid feedback control loop 310, and the key motion is controlled through the hybrid feedback control loop 310. The solenoids directly give rise to the linear motion of the plungers 6*a*, and indirectly exert the force through the plungers 6*a* on the black/white keys 1*a*/1*b* so as to give rise to the angular motion. In other words, the solenoid-operated key actuators 6 and black/white keys 1*a*/1*b* are independent of one another. This means that the current key position is not always consistent with the current plunger position. For this reason, both of the plungers 6*a* and black/white keys 1*a*/1*b* are directly monitored with the plunger sensors 35 and key sensors 25, and the servo controller 12 takes both pieces of positional data into account for the precise feedback control.

Figure 3:
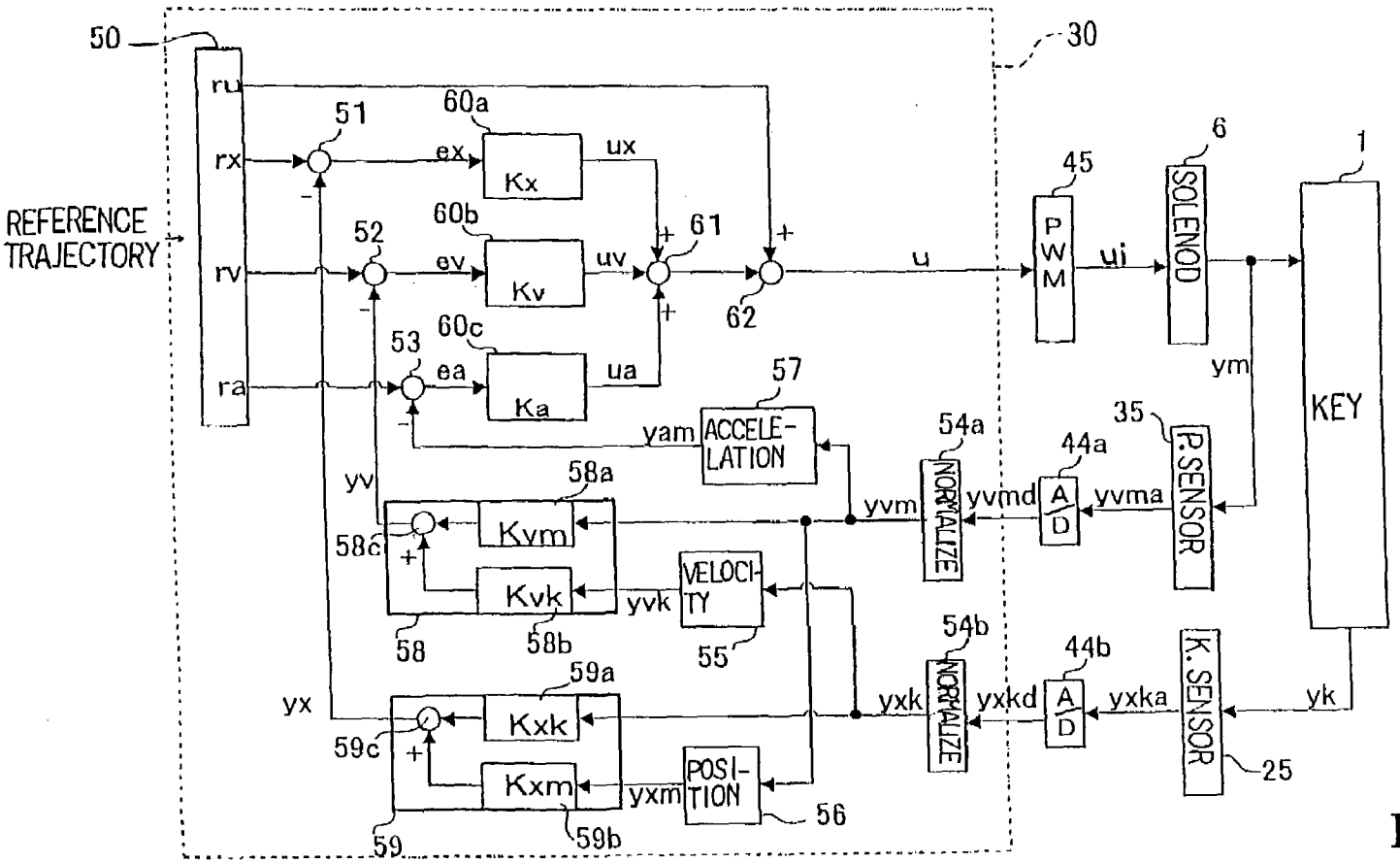
FIG. 3 is a block diagram showing a hybrid feedback control loop created in the automatic player piano.

FIG. 3 shows the hybrid feedback control loop 310. Although all the black/white keys 1*a*/1*b* are controlled through the hybrid feedback control loop 310, the hybrid feedback control loop 310 is focused on only one of the black/white keys 1*a*/1*b* for the sake of simplicity.

Boxes 50/54*a*/54*b*/55/56/57/58/59/60*a*/60*b*/60*c* and circles 51/52/53/61 stand for functions of the motion controller/servo controller 11/12 in more detail. The analog-to-digital converters 44*a*/44*b* are incorporated in the interface 44.

The piece of control data representative of the reference trajectory is supplied to the box 50. The box 50 determines pieces of control data representative of the target position, target velocity and target acceleration on the basis of the piece of control data representative of the reference trajectory at the intervals of 1 millisecond, and outputs a target position signal rx representative of the target position, a target velocity signal rv representative of the target velocity, a target acceleration signal ra representative of the target acceleration and a constant bias ru. The constant bias ru expresses a part of the duty ratio, and the part of the duty ratio adds a component to the thrust exerted on the plunger 6*a*. The component thus added to the thrust is equivalent to the resistance against the plunger motion, and is determined through an experiment. The constant bias ru is desirable, because the plunger is sharply raised. The target position signal rx, target velocity signal rv, target acceleration signal ra and constant bias ru are respectively supplied to the circles 61/51/52/53, which express the addition as will be described hereinlater in detail.

While the solenoid of the associated solenoid-operated key actuator 6 is exerting the thrust on the plunger 6*a* in the magnetic field, the plunger 6*a* projects from the solenoid, and gives rise to the key motion. The current plunger velocity ym is transformed to the analog plunger velocity signal yvma by means of the plunger sensor 35, and the current key position is transformed to the analog key position signal yk by means of the key sensor 25.

The analog key position signal yxka and analog plunger velocity signal yvma are respectively converted to a digital key position signal yxkd representative of the current key position and a digital plunger velocity signal yvmd representative of the current plunger position through the analog-to-digital converters 44*a*/44*b*, respectively, and are supplied to the boxes 54*a*/54*b*, respectively.

The boxes 54*a*/54*b* stand for the normalization. Since the current key position and current plunger velocity are expressed in different units, the boxes 54*a*/54*b* carry out a linear transformation, and produce a digital normalized key position signal yxk and a digital normalized plunger velocity signal yvm. The digital normalized key position signal yxk and digital normalized plunger velocity signal yvm are supplied to the boxes 55/59 and boxes 56/57/58, respectively.

The box 55 stands for a differentiation on the pieces of normalized key position data expressed by the digital normalized key position signal yxk. A polynomial approximation is available for the differentiation. For example, previous seven pieces of normalized key positions and the next seven pieces of normalized key positions are read out from the queue, and the fourteen pieces of normalized key positions are approximated to a curve of the second order. The box 55 determines a current key velocity on the basis of the curve of the second order, and produces a digital normalized key velocity signal yvk representative of a current key velocity.

The box 56 stands for an integration on the pieces of normalized plunger velocity data expressed by the digital normalized plunger velocity signal, and produces a digital normalized plunger position signal yvk representative of a current plunger position.

The box 57 stands for a differentiation on the pieces of normalized plunger velocity data expressed by the digital normalized plunger velocity signal, and produces a digital normalized plunger acceleration signal yvm. The polynomial approximation is also used for the differentiation.

The box 58 stands for the determination of the weighted current velocity. The function of the box 58 is broken down into multipliers 58*a*/58*b* and an adder 58*c*. The digital normalized plunger velocity signal yvm is supplied to the multiplier 58*a*, and the piece of normalized plunger velocity data is weighted by "Kvm". Similarly, the digital normalized key velocity signal yvk is supplied to the multiplier 58*b*, and the piece of normalized key velocity data is weighted by "Kvk". After the multiplication, the digital normalized plunger velocity signal yvm expresses a piece of weighted plunger velocity data, and the digital normalized key velocity signal yvk expresses a piece of weighted key velocity data. The piece of weighted plunger velocity data is added to the piece of weighted key velocity data so that the box 58 outputs the composite current velocity signal yv representative of the current weighted velocity.

The box 59 stands for the determination of the current weighted position. The function of the box 59 is broken down into multipliers 59*a*/59*b* and an adder 59*c*. The digital normalized key position signal yxk is supplied to the multiplier 59*a*, and the piece of normalized key position data is weighted by weighting factor "Kxk". The digital normalized plunger position signal yxm is supplied to the multiplier 59*b*, and the piece of normalized plunger positional data is weighted by weighting factor "Kxm". After the multiplication, the digital normalized plunger position signal yxm expresses a piece of weighted plunger positional data, and the digital normalized key position signal al yxk expresses a piece of weighted key positional data. The piece of weighted plunger positional data is added to the piece of weighted key positional data so that the box 59 outputs the composite current positional signal yx representative of the current weighted position.

The weighting factors Kvm and Kvk are determined through an experiment, and always satisfy the following equation Kvm+Kvk=1. Which weighting factor Kvm or Kvk is to be influential is depending upon the structure of the acoustic piano 100, characteristics of the sensors 25/35 and so forth. Using a certain model of the automatic player piano, the present inventors determined proper values of the weighting factors Kvm and Kvk for the automatic player piano through the experiment. The proper values of the weighting factors Kvm and Kvk were 0.7 and 0.3, respectively.

Similarly, the weighting factors Kxm and Kxk are determined through an experiment, and always satisfy the following equation Kxm+Kxk=1. Which weighting factor Kxm or Kxk is to be influential is also depending upon the structure of the acoustic piano 100, characteristics of the sensors 25/35 and so forth. Using the certain model of the automatic player piano, the present inventors determined proper values of the weighting factors Kxm and Kxk for the automatic player piano through the experiment. The proper values of the weighting factors Kxk and Kxm were 0.9 and 0.1, respectively.

In this instance, any current weighted acceleration is not determined. Of course, it is possible to prepare another box similar to the boxes 58/59 for the current weighted acceleration. However, the current key acceleration is less accurate. This is because of the fact that the differentiation is to be carried out twice for the current key acceleration. The inaccurate weighted acceleration makes the duty ratio unreliable. For this reason, the digital plunger acceleration signal yam is directly compared with the target acceleration as will be hereinafter described in conjunction with the circle 53.

The circles 51/52/53 stand for subtraction. The target position rx is subtracted from the current weighted position through the circle 51, and the difference ex is output from the circle 51. The target velocity rv is subtracted from the current weighted velocity through the circle 52, and the difference ev is output from the circle 52. The target acceleration ra is subtracted from the current plunger acceleration through the circle 53, and the difference ea is output from the circle 53.

The boxes 60*a*/60*b*/60*c* stands for multiplication. The difference ex is multiplied by a servo gain kx through the box 60*a*, and the product ux is output from the box 60*a*. The difference ev is multiplied by a servo gain kv through the box 60*b*, and the product uv is output from the box 60*b*. The difference ea is multiplied by a servo gain ka through the box 60*c*, and the product ua is output from the box 60*c*.

The servo gains kx/kv/ka are determined through an experiment. Using a certain model of the automatic player piano, the present inventors carried out the experiment, and determined proper values of the servo gains kx/kv/ka. The proper values for the certain model were 1.7, 3.5 and 0.5, respectively. Thus, the velocity control was weighted in the hybrid feedback control loop of the certain model of the automatic player piano.

The circles 61 and 62 stand for the addition. The products ux/uv/ua are added to one another through the circle 61, and the constant bias ru is further added to the sum, i.e., (ux+uv+ua) through the other circle 62. The sum "u", i.e., (ux+uv+ua+ru) is representative of the proper duty ratio, and is supplied to the pulse width modulator 45.

The pulse width modulator 45 adjusts the driving signal ui to the proper duty ratio, and supplies the driving signal to the solenoid of the associated solenoid-operated key actuator 6.

In the first embodiment, the position and velocity are corresponding to the physical quantity. The servo position control, servo velocity control and servo acceleration control are achieved through the hybrid feedback control loop 310. The servo velocity control serves as a differential compensator from the aspect of the servo position control, and the servo position control and servo acceleration control respectively serve as an integral compensator and a differential compensator.

Figure 4A:
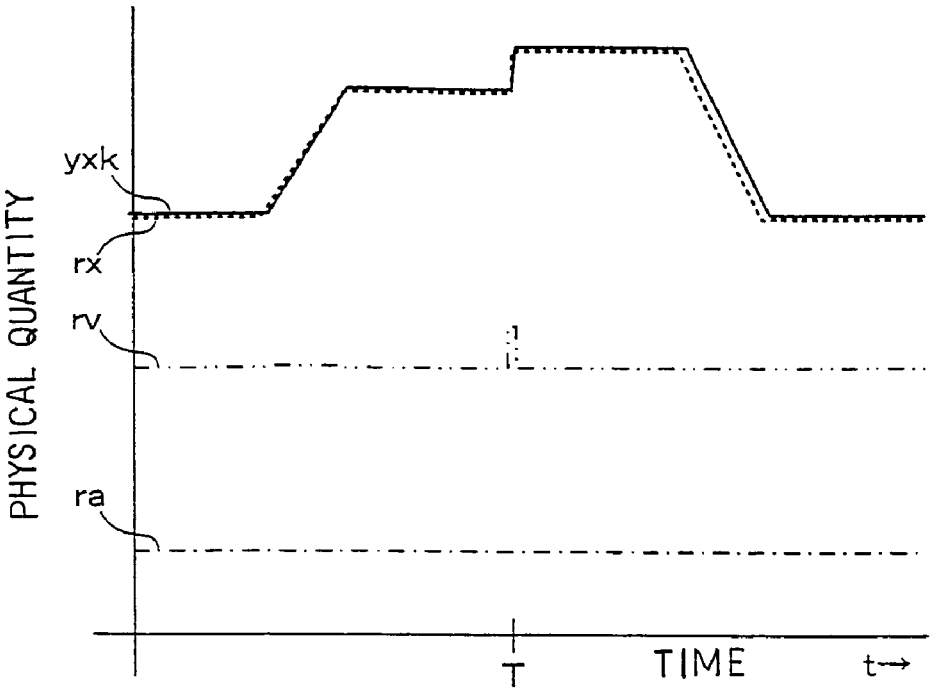
FIG. 4A is a graph showing standard key motion reproduced on the basis of a reference trajectory through the hybrid feedback control loop.

The present inventors evaluated the hybrid feedback control loop 310. The present inventors plotted the target position rx, target velocity rv and target acceleration ra in FIG. 4A. The target position rx indicated that the key was gradually depressed toward the end position and, thereafter, recovered to the rest position. In other words, the target position rx expressed the standard key motion of the key. The key was controlled through the hybrid feedback control loop 310, and the key motion was expressed by plots yxk. The plots yxk were indicative of the current key position determined on the basis of the key position signal output from the key sensor 25. Comparing plots rx with plots yxk, it was understood that the hybrid feedback control loop 310 was conducive to the faithful reproduction of the standard key motion. The target position rx was rapidly deepened at time T. Since the target velocity rv was also rapidly raised, the current key position yxk closely followed the target key position rx. Thus, the servo velocity control made the promptness of the hybrid feedback loop 310 improved.

Figure 4B:
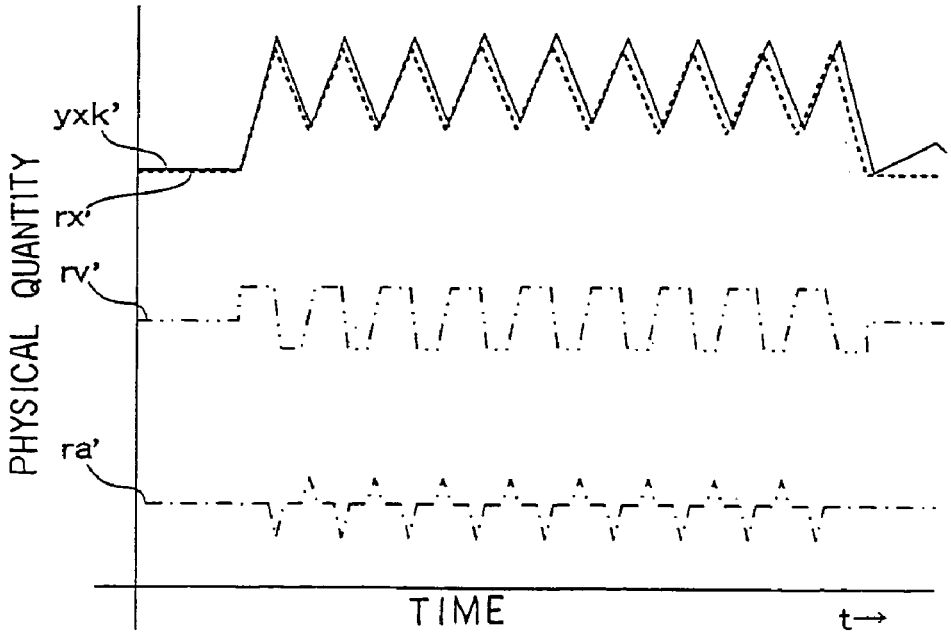
FIG. 4B is a graph showing repetition reproduced on the basis of a reference trajectory through the hybrid feedback control loop.

The present inventors plotted the target position rx', target velocity rv' and target acceleration ra' in FIG. 4B. The target position rx' indicated that the key was repeatedly depressed like trill. The key was also controlled through the hybrid feedback control loop 310, and the key motion was expressed by plots yxk'. The plots yxk were indicative of the current key position determined on the basis of the key position signal output from the key sensor 25. Comparing plots rx' with plots yxk', it was understood that the hybrid feedback control loop 310 made the trill faithfully reproduced. The reason why the key faithfully followed was that the servo acceleration control was incorporated in the hybrid feedback control loop 310. The contribution of the servo acceleration was readable from plots ra'. Thus, the present inventors confirmed that the hybrid feedback loop 310 made it possible to faithfully reenact the performance expressed by the set of music data codes.

As will be understood from the foregoing description, the hybrid feedback control loop 310 contains two sorts of sensors, i.e., the key sensors 25 and plunger sensors 35, and the pieces of current physical quantity data are appropriately weighted by the respective weighting factors for determining the current weighted physical quantity. The current weighted physical quantity is compared with the target physical quantity on the reference trajectory so as to determine the proper magnitude of the driving signal, and the key actuator 6 is controlled with the driving signal. Although the plunger motion is not exactly corresponding to the key motion, the weighting factors make the composite current physical quantity well correspond to the target physical quantity so that the black/white keys 1*a*/1*b* are well controlled through the hybrid feedback control loop 310. As a result, the key motion is exactly reproduced in the playback, and the automatic playing system 300 faithfully reenacts the performance.

Second Embodiment

Figure 5:
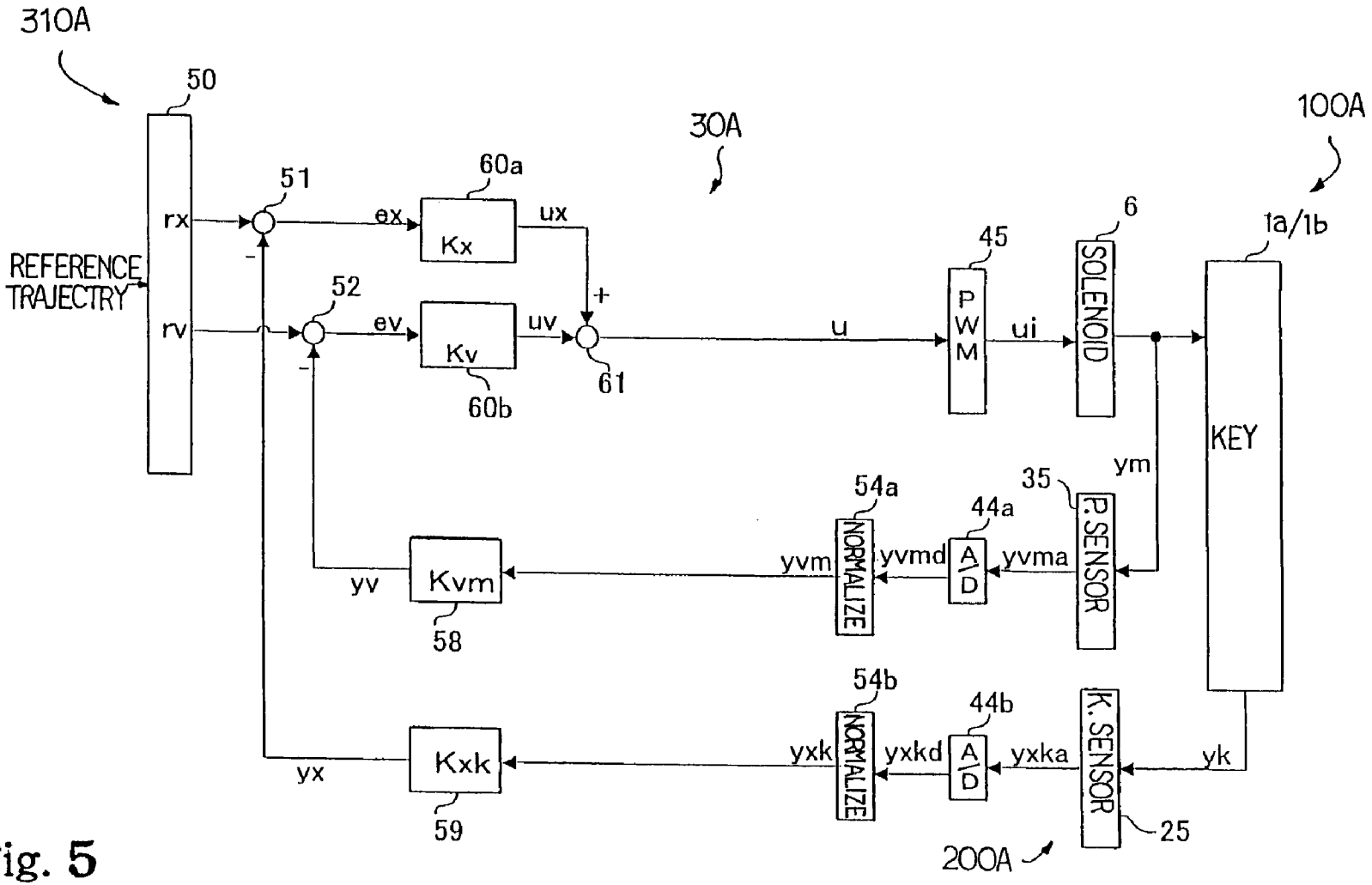
FIG. 5 is a block diagram showing another hybrid feedback control loop incorporated in another automatic player piano according to the present invention.

Turning to FIG. 5 of the drawings, a hybrid feedback control loop 310A is incorporated in another automatic player piano embodying the present invention. The automatic player piano implementing the second embodiment also comprises an acoustic piano 10A, a recording system and an automatic playing system. The acoustic piano 100A and recording system 200A are similar to the acoustic piano 100 and recording system 200 so that component parts are labeled with the references designating the corresponding component parts of the acoustic piano/recording system 100/200.

Several functions are deleted from the controller 30A so that the hybrid feedback control loop 310A is simpler than the hybrid feedback control loop 310. The remaining functions of the controller 30A are labeled with the references designating the corresponding functions of the controller 30.

The digital plunger velocity signal yvdm is normalized, and the digital normalized plunger velocity signal yvm is weighted by a weighting factor Kvm. The digital weighted plunger velocity signal yv is compared with the target velocity rv without producing any composite current velocity signal. Similarly, the digital key position signal yxkd is normalized, and the digital normalized key position signal yxk is weighted by a weighting factor Kxk. The digital weighted key position signal yx is compared with the target position rx without producing any composite current positional signal. Neither acceleration nor constant bias ru is taken into account.

Using a standard model of the automatic player piano, the present inventors evaluated the hybrid feedback loop 310A. The present inventors confirmed that the keys faithfully traveled on the reference trajectories on the condition that the weighting factors Kvm and Kxk were fallen within the numerical range between 0.1 and 2 and the numerical range between 0.1 and 2, respectively.

When the weighting factors kvm and Kxk were adjusted to respective values equal to 0.1 and less than 1, the target key tended to overspeed, i.e., move over the target speed rv. On the other hand, when the weighting factors Kvm and Kxk were adjusted to 1, the target key were liable to follow the target speed rv. When the weighting factors Kvm and Kxk were adjusted to respective values greater than 1 and equal to 2, the target key tends to be damped.

Although particular embodiments of the present invention have been shown and described, it will be apparent to those skilled in the art that various changes and modifications may be made without departing from the spirit and scope of the present invention.

For example, the moving-magnet type velocity sensors 35 do not set any limit to the technical scope of the present invention. Any sort of velocity sensor is available for the plunger 6*a*.

The computer programs may be downloaded from a suitable source through a communication network such as, for example, the internet to the random access memory 42. Similarly, the parameters may be supplied from the suitable source together with the computer programs.

The boxes 57/60*c* and circle 53 may be deleted from the hybrid feedback control loop 310. The boxes 55/58 may be added to the hybrid feedback control loop 310A. Thus, the hybrid feedback control loops 310/310A have various modifications.

The hybrid feedback control loop 310/310A may be provided in association with pedals of the acoustic piano. The actuators 6 may give rise to motion of the action units 2. Thus, the black/whit keys 1*a*/1*b* do not set any limit to the technical scope of the present invention.

The proper values of the weighting factors Kvm/Kvk/Kxk/Kxm are varied depending upon the model of the automatic player piano, and do not set any limit to the technical scope of the present invention.

The plunger sensor 35 and key sensor 25 may be respectively replaced with a plunger sensor for detecting the current plunger position and a key sensor for detecting a key velocity. In this instance, the current plunger velocity is calculated through differentiation, and the current key position and current key acceleration are calculated through integration and differentiation, respectively. Otherwise, both of the key sensor and plunger sensor may detect the key velocity and plunger velocity, respectively, or the key position and plunger position, respectively. Thus, the combination of the sensors 25/35 does not set any limit to the technical scope of the present invention.

The acoustic piano 100/100A may be replaced with another sort of keyboard musical instrument such as, for example, an upright piano, a mute piano and a harpsichord. The keyboard musical instrument does not set any limit to the technical scope of the present invention. The hybrid feedback control loop 310/310A may be incorporated in a suitable percussion instrument such as, for example, a celesta or a drum set.

The solenoid-operated actuators 6 do not set any limit to the technical scope of the present invention. Pneumatic actuators or micro-motors may drive the black/white keys 1*a*/1*b*. Moreover, the key actuators 6 may be provided over the keyboard 1 so as to exert the force on the front portions of the black/white keys 1*a*/1*b*. Thus, the location of the solenoid-operated key actuators 6 does not set any limit to the technical scope of the present invention.

If the key sensors 25 and plunger velocity sensors are well tuned, the normalization is not required for the digital key position signals and digital plunger velocity signals. Thus, the boxes 54*a* and 54*b* are not indispensable elements of the present invention. Similarly, the key sensors 25 and plunger velocity sensors 35 may be replaced with digital key sensors and digital plunger velocity sensors so as to delete the analog-to-digital converters 44*a*/44*b*.

The component parts of the automatic player pianos are correlated with claim languages as follows. The strings 4 as a whole constitute a "sound generator", and the tones, which are generated from the vibrating strings 4, are corresponding to "different sorts of music sound". The black/white key 1*a*/1*b*, action unit 2 and hammer 3 form in combination each link work, and the black/white key 1*a*/1*b* serves as a "component part". The hybrid feedback control loops 310/310A are corresponding to a "control loop". The preliminary processor 10 and motion controller 11 form in combination a "data generator". The solenoid-operated key actuators 6 serve as "plural actuators", respectively, and the plungers 6*a* are corresponding to "movable members". The key sensors 25 and plunger velocity sensors 35 serve as "sensors" and "other sensors", and the current key position and current plunger velocity are corresponding to "a physical quantity" and "another physical quantity", respectively.

The key position signal and plunger velocity signal serve as "detecting signals" and "other detecting signals", and the current key position and current plunger velocity are respectively corresponding to "a physical quantity" and "another physical quantity". The target position rx and target velocity rv are equivalent to "a target physical quantity" and "another target physical quantity", respectively. The weighting factors Kxk and Kxm serve as "a first parameter" and "a second parameter" of "a weighting factor", and the weighting factor Kvm and Kvk serve as "a first parameter" and "a second parameter" of "another weighting factor" in the first embodiment. The weighting factor Kxk and weighting factor Kvm serve as "a weighting factor" and "another weighting factor" in the second embodiment.

"Pieces of status data representative of a weighted physical quantity and another weighted physical quantity" are carried on the composite current positional signal/current positional signal yx and composite current velocity signal/current velocity signal yv. Thus, the current weighted position and current weighted velocity serve as the "weighted physical quantity" and "another weighted physical quantity", respectively. The sum u is corresponding to "a piece of instruction data".

The boxes 56 and 55 serve as "an integrator" and "a differentiator", respectively, and the boxes 59*a*, 59*b*, 58*a* and 58*b* and circles 59*c* and 58*c* are corresponding to "a multiplier", "another multiplier", "yet another multiplier", "still another multiplier", "an adder" and "another adder", respectively. The boxes 50, 60*a*, 60*b*, 60*c* and circles 51, 52, 53, 61, 62 as a whole constitute "a comparator". The boxes 60*a*, 60*b* and 60*c* are corresponding to "an amplifier", "another amplifier" and "yet another amplifier", respectively, and the box 57 serves as "another differentiator".

What is claimed is:

1. An automatic player musical instrument for producing music sound, comprising:

a sound generator actuated for producing said music sound at different pitches;

plural link works making a motion so as to actuate said sound generator, and having respective component parts; and a control loop associated with said component parts, and including a data generator outputting pieces of control data representative of reference trajectories on which said component parts are expected to travel, plural actuators provided in association with said component parts, respectively, having respective movable members for exerting force on said component parts and responsive to driving signals so as to give rise to said motion through said movable members, sensors respectively monitoring said component parts and producing detecting signals representative of a physical quantity of said component parts, other sensors respectively monitoring said movable members and producing other detecting signals representative of another physical quantity of said movable members different from said physical quantity, a servo controller connected to said data generator, said sensors and said other sensors, determining pieces of target data representative of a target physical quantity and another target physical quantity, respectively weighting said physical quantity and said another physical quantity by a weighting factor and another weighting factor for producing pieces of status data representative of a weighted physical quantity and another weighted physical quantity and comparing said target physical quantity and said another target physical quantity with said weighted physical quantity and said another weighted physical quantity for determining a piece of instruction data representative of a proper magnitude of said driving signals, and a modulator connected between said servo controller and said plural actuators and responsive to said piece of instruction data for adjusting said driving signals to said proper magnitude.

2. The automatic player musical instrument as set forth in claim 1, in which said physical quantity and said another physical quantity are categorized in different sorts of physical quantity, respectively.

3. The automatic player musical instrument as set forth in claim 1, in which a current position and a current velocity serve as said physical quantity and said another physical quantity, respectively.

4. The automatic player musical instrument as set forth in claim 3, in which said servo controller determines another current position of said movable member and another current velocity of said component part on the basis of said another physical quantity and said physical quantity, respectively, said weighting factor includes a first parameter multiplied by said current position and a second parameter multiplied by said another current position, and said another weighting factor includes a third parameter multiplied by said current velocity and a fourth parameter multiplied by said another current velocity.

5. The automatic player musical instrument as set forth in claim 4, in which the sum of said first and second parameters is equal to the sum of said third and fourth parameters.

6. The automatic player musical instrument as set forth in claim 5, in which said sum is equal to 1.

7. The automatic player musical instrument as set forth in claim 4, in which said servo controller includes an integrator connected to each of said other sensors and calculating said another current position on the basis of said current velocity, a multiplier connected to each of said sensors and weighting said current position by said first parameter, another multiplier connected to said integrator and weighting said another current position by said second parameter, an adder connected to said multiplier and said another multiplier and adding a product output from said multiplier to another product output from said another multiplier so as to determine said weighted physical quantity, a differentiator connected to said each of said sensors and calculating said another current velocity on the basis of said current position, yet another multiplier connected to said each of said other sensors and weighting said current velocity by said third parameter, still another multiplier connected to said differentiator and weighting said another current velocity by said fourth parameter, another adder connected to said yet another multiplier and said still another multiplier and adding a product output from said yet another multiplier to a product output from said still another multiplier so as to determine said another weighted physical quantity, and a comparator connected to said data generator, said adder and said another adder and comparing said weighted physical quantity and said another weighted physical quantity with said target physical quantity and said another target physical quantity so as to determine said proper magnitude on the basis of differences between said weighted physical quantity and said target physical quantity and between said another weighted physical quantity and said another target physical quantity.

8. The automatic player musical instrument as set forth in claim 7, in which said comparator includes another data generator connected to said data generator and determining said target physical quantity and said another target physical quantity on the basis of each reference trajectory, a subtractor connected to said another data generator and said adder and calculating one of the differences between said weighted physical quantity and said target physical quantity, another subtractor connected to said another data generator and said another adder and calculating another of said differences between said another weighted physical quantity and said another target physical quantity, an amplifier connected to said subtractor and multiplying said one of said differences by a gain, another amplifier connected to said another subtractor and multiplying said another of said differences by another gain, and yet another adder connected to said amplifier and said another amplifier and calculating a sum of a product output from said amplifier and a product output from said another amplifier so as to determine said proper magnitude.

9. The automatic player musical instrument as set forth in claim 7, in which said servo controller further includes another differentiator connected to said each of said other sensors, calculating a current acceleration on the basis of said current velocity so as to supply said current acceleration to said comparator, and said servo controller further determines a target acceleration so as to determine yet another of said differences between said current acceleration and said target acceleration for determining said proper magnitude.

10. The automatic player musical instrument as set forth in claim 9, in which said comparator includes another data generator connected to said data generator and determining said target physical quantity and said another target physical quantity on the basis of each reference trajectory, a subtractor connected to said another data generator and said adder and calculating one of the differences between said weighted physical quantity and said target physical quantity, another subtractor connected to said another data generator and said another adder and calculating another of said differences between said another weighted physical quantity and said another target physical quantity, yet another subtractor connected to said another data generator and said another differentiator and calculating yet another of said differences between said current acceleration and said target acceleration, an amplifier connected to said subtractor and multiplying said one of said differences by a gain, another amplifier connected to said another subtractor and multiplying said another of said differences by another gain, yet another amplifier connected to said yet another subtractor and multiplying said yet another of said differences by yet another gain, and yet another adder connected to said amplifier, said another amplifier and said yet another amplifier and calculating a sum of a product output from said amplifier, a product output from said another amplifier and a product output from said yet another amplifier so as to determine said proper magnitude.

11. The automatic player musical instrument as set forth in claim 10, in which said another data generator further supplies a constant bias equivalent to a resistance against a motion of each movable member, and said comparator further includes still another adder connected to said another data generator and yet another adder for adding said constant bias to said sum so as to determine said proper magnitude.

12. The automatic player musical instrument as set forth in claim 3, in which said servo controller directly multiplies said physical quantity and said another physical quantity by said weighting factor and said another weighting factor, respectively, so as to determine said weighted physical quantity and said another weighted physical quantity.

13. The automatic player musical instrument as set forth in claim 12, in which said servo controller includes a multiplier connected to each of said sensors and multiplying said physical quantity by said weighting factor so as to determine said weighted physical quantity, another multiplier connected to each of said other sensors and multiplying said another physical quantity by said another weighting factor so as to determine said another weighted physical quantity, and a comparator connected to said data generator, said multiplier and said another multiplier and comparing said weighted physical quantity and said another weighted physical quantity with said target physical quantity and said another physical quantity so as to determine said proper magnitude on the basis of differences between said weighted physical quantity and said target physical quantity and between said another weighted physical quantity and said another target physical quantity.

14. The automatic player musical instrument as set forth in claim 13, in which said comparator includes another data generator connected to said data generator and determining said target physical quantity and said another target physical quantity on the basis of each reference trajectory, a subtractor connected to said another data generator and said multiplier and calculating one of said differences between said weighted physical quantity and said target physical quantity, an amplifier connected to said subtractor and multiplying said one of said differences by a gain, another subtractor connected to said another data generator and said another multiplier and calculating another of said differences between said another weighed physical quantity and said another target physical quantity, another amplifier connected to said another subtractor and multiplying said another of said differences by another gain, and an adder connected to said amplifier and said another amplifier and adding a product output from said amplifier to a product output from said another amplifier so as to determine said proper magnitude.

15. The automatic player musical instrument as set forth in claim 1, in which said sound generator includes plural strings vibratory to generate said music sound at said different pitches.

16. The automatic player musical instrument as set forth in claim 15, in which each of said plural link works includes a key movable between a rest position and an end position, an action unit linked with said key so as to be actuated and a hammer driven for rotation by said action unit for striking one of said plural strings.

17. The automatic player musical instrument as set forth in claim 16, in which said key serves as one of said component parts.

18. The automatic player musical instrument as set forth in claim 17, in which said plural actuators are provided below the rear portions of the keys, and said movable members upwardly push said rear portions.

19. The automatic player musical instrument as set forth in claim 17, in which solenoid-operated key actuators serve as said plural actuators so that plungers upwardly pushes the rear portions of said keys in the presence of said driving signals.

20. The automatic player musical instrument as set forth in claim 19, in which said modulator adjusts said driving signals to a proper duty ratio corresponding to said proper magnitude.

* * * * *